United States Patent [19]

Moll et al.

[11] Patent Number: 4,990,440

[45] Date of Patent: Feb. 5, 1991

[54] PHOTOGRAPHIC SILVER HALIDE EMULSION CONTAINING GELATINE

[75] Inventors: Franz Moll, Leverkusen; Bruno Mücke, Bergisch Gladbach; Walter Pätzold; Klaus Wagner, both of Leverkusen, all of Fed. Rep. of Germany

[73] Assignee: Agfa-Gevaert Aktiengesellschaft, Leverkusen, Fed. Rep. of Germany

[21] Appl. No.: 389,419

[22] Filed: Aug. 4, 1989

[30] Foreign Application Priority Data

Aug. 20, 1988 [DE] Fed. Rep. of Germany ..... 3828311

[51] Int. Cl.[5] ..... G03C 1/10; G03C 1/34

[52] U.S. Cl. ..... 430/640; 430/545; 430/599; 430/603; 430/605; 430/607; 430/642

[58] Field of Search ..... 430/599, 603, 605, 607, 430/640, 642, 545

[56] References Cited

U.S. PATENT DOCUMENTS

| | | | |
|---|---|---|---|
| 3,763,138 | 10/1973 | Rakoczy | 430/642 |
| 4,021,244 | 5/1977 | Nagatomo et al. | 430/642 |
| 4,145,455 | 3/1979 | Fujimaki et al. | 430/642 |
| 4,481,359 | 11/1984 | Beutel et al. | 430/600 |
| 4,514,492 | 4/1985 | LeStrange et al. | 430/600 |

FOREIGN PATENT DOCUMENTS

| | | | |
|---|---|---|---|
| 60-3621 | 1/1985 | Japan | 430/640 |

OTHER PUBLICATIONS

Gelatin, The Theory of the Photographic Process, Fourth Edition, Macmillan Publishing Co., Inc., New York, pp. 55, 1977.

*Primary Examiner*—Hoa Van Le

*Attorney, Agent, or Firm*—Connolly & Hutz

[57] ABSTRACT

The sensitivity/fog ratio can be improved by using photographic silver halide emulsions containing gelatine which has a cysteine content of less than 10 ppm and a gold number of ≧23 μmol/g.

4 Claims, 2 Drawing Sheets

FIG. 1

PHOTOGRAPHIC SILVER HALIDE EMULSION CONTAINING GELATINE

Figure 1:
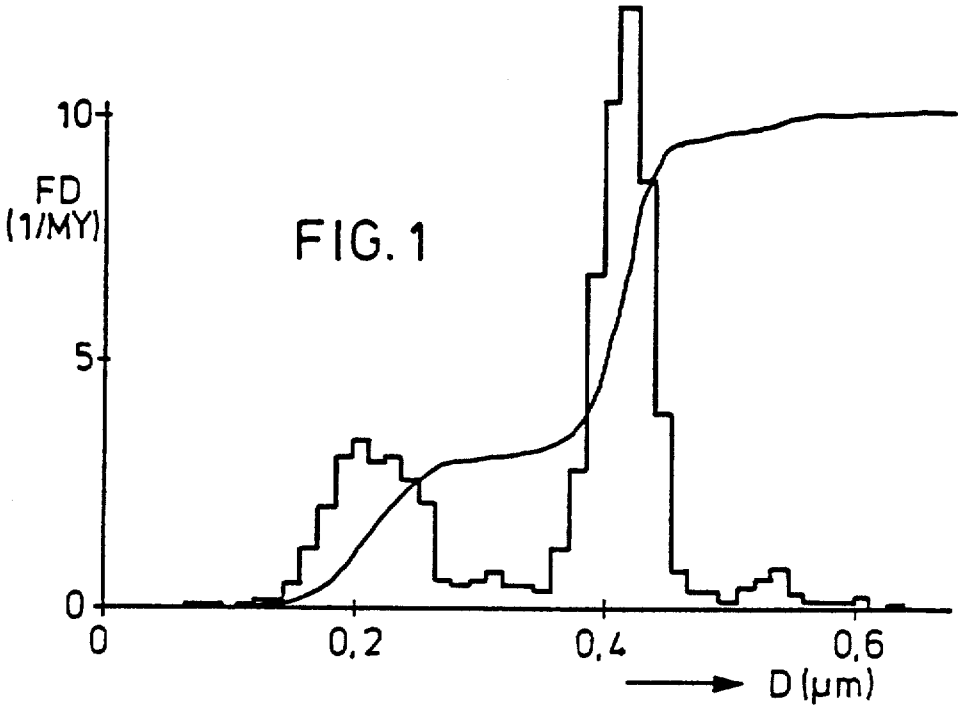

This invention relates to a photographic silver halide emulsion containing gelatine, which emulsion has an improved sensitivity/fog ratio by virtue of containing a particular gelatine.

The gelatines nowadays used for photographic silver halide emulsions are generally so called inert gelatines, i.e. gelatines which are substantially free from photographically active impurities such as thiosulphate, sulphite or nitrite, and these gelatines are preferably prepared from high quality raw materials, in particular bones, especially hard bones.

In spite of this, the inert gelatines are not composed purely of the amino acids found in the collagen but also contain sugar, aldehydes and muco proteins.

The use of inert gelatines not only has great advantages for emulsion technology since the retarders and ripening bodies required for precipitation and ripening can be added in the optimum doses for each emulsion but it also has the advantage that inert gelatines can be prepared more uniformly then, for example, active gelatines which contain certain ripening substances and retarders, usually of natural origin.

But even with inert gelatines there is the possibility that subsequent samples produce different sensitometric values even though no differences can be detected by the conventional analytical processes. This is a highly unsatisfactory state for the manufacture of photographic materials.

It has now been found that this disadvantage can be avoided by using gelatines which have an exceptionally low cysteine content and a gold number of at least 23 μmol/g of gelatine.

The present invention thus relates to a photographic silver halide emulsion containing gelatine, in which the gelatine has a cysteine content of less than 10 ppm and a gold number of $\geqq 23$ μmol/g.

The cysteine content of the gelatine is preferably $\leqq 8$ ppm, the isoelectric point (IEP) of such a gelatine being preferably from 4.9 to 5.2.

Cysteine, an amino acid which contains a sulphydryl group, does not occur in the gelatine molecule but is an impurity which may be derived from keratins, albumins or muco proteins, the latter occurring particularly frequently as impurities of collagen in animal organisms.

Inert gelatines prepared from acid treated collagen (bones, ox hide, pig skin) having an IEP of $>7$ contain relatively large quantities of cysteine (approximately 25 ppm) while collagen which has been obtained by alkaline treatment in the usual manner gives rise to gelatines with an IEP of 4.9 to 5.1 and a cysteine content of 12 to 16 ppm.

The cysteine content of gelatine is determined by a method described by H. Meichelbeck, A. G. Hack and Chr. Sentler in Z. Ges. Textilindustrie 70, 242, (1968). 1 ml of water and 1 ml of a 30% by weight $H_2SO_4$ solution is added to 1 g of gelatine and the mixture is hydrolysed for 60 minutes on a boiling water bath and when the mixture has cooled the pH is adjusted to 7.4 by the addition of 3 m tris-(hydroxymethyl)-amino methane (TRIS) and a TRIS/HCl buffer. 5,5'-dithiobis-(2-nitrobenzoic acid) (DTNB) is used as colour indicator. The determination is carried out at 412 nm. The comparison solution used is the same as the solution to be measured but without the hydrolysate. Since, however, gelatine hydrolysates have various colours which absorb in this region, the hydrolysate must also be measured together with all the additives except the DTNB and the result must be subtracted from the value obtained for the extinction of the solution to be measured.

The buffer is prepared as follows: 121 g of TRIS are dissolved in 500 ml of water and the pH is adjusted to 7.4 with HCl. The solution is then made up to 1000 ml.

Reagent solution: 10 ml of TRIS/HCl buffer are diluted with water to about 50 ml and 25 mg of reagent (DTNB) and 20 mg of EDTA salt are dissolved in the diluted buffer. The pH is adjusted to 4 with HCl and the solution is made up to 100 ml. 3 m of TRIS is also required for adjusting the pH of the gelatine hydrolysate.

A double determination is essential for obtaining accurate values. The range of error of the measurement must not be greater than $\pm 1$ ppm.

The cysteine content is obtained from the measured values by means of a previously determined calibration curve. According to H. Meichelbeck et. al., loc. cit., the cysteine content may also be calculated from the measured value without a calibration curve.

To determine the gold number, the gelatine is titrated potentiometrically with tetrachloro gold acid at pH 2. The gold number is obtained from the quantity of gold reduced by the gelatine. Gelatines which are not oxidized are found to have gold numbers of $\sim 23$ μmol/g by this method; this corresponds approximately to a methionine content of $\sim 50$ μmol/g.

Both determination of the gold number and the cysteine analysis are accurately reproducible.

Gelatines which have the low cysteine content indicated above may be obtained by oxidation of gelatine, for example with hydrogen peroxide or per acids such as performic acid, peracetic acid or periodic acid. The gold number, however, then falls below the required 23 μmol/g so that oxidized gelatines cannot be used for the purpose of this invention. Although oxidized gelatines have an advantageous effect on the particle size distribution of the silver halide particles, they result in an undesirably high fog.

Gelatines with a low cysteine content suitable for the purpose of this invention may be obtained by alkaline liming of beef bones for longer than the conventional period. The amount by which the liming period must be extended may be determined by means of cysteine analyses according to H. Meichelbeck et. al.

When the gelatines according to the invention are used, inhibition of the grain growth is found to be substantially reduced and optimum sensitivity combined with minimum fogging is obtained after chemical ripening of the emulsion.

Preparation of the photographic emulsion containing gelatine is carried out by precipitation of the silver halide in the presence of the gelatines, flocculation and washing of the silver halide which has been precipitated in the presence of gelatine, followed by redispersion of the silver halide, optionally with the addition of a further quantity of gelatine.

The gelatine added for the precipitation process may be a gelatine according to the invention or an oxidized gelatine or any mixture of the two. The gelatine according to the invention has to be used for the redispersion of the silver halide. It is preferable to use only the gelatine according to the invention.

The gelatine/silver ratio by weight (GeSi) of the finished emulsion is preferably from 1:1 to 1:5, the silver being calculated as silver nitrate.

The ratio by weight of the quantity of gelatine present at the stage of precipitation to the quantity of gelatine added for the redispersion may be up to 1:10 and is preferably from 1:1 to 1:5, i.e. the total quantity of gelatine could already be added at any stage of precipitation.

The gelatine according to the invention may be deionised or not.

The silver halide present as light sensitive component of the photographic emulsion may be composed of silver chloride, silver bromide, silver iodide or mixtures thereof. For example, the halide content of at least one layer may be composed of from 0 to 15 mol % of iodide, from 0 to 100 mol % of chloride and from 0 to 100 mol % of bromide. Silver iodobromide emulsions are generally used for colour negative and colour reversal films and silver chlorobromide emulsions for colour negative and colour reversal paper. The silver halides may be in the form of predominantly compact crystals which may be e.g. in the form of regular cubes or octahedrons or transitional forms. The halides may also contain tabular crystals having an average ratio of diameter to thickness of preferably at least 5:1, the diameter of a grain being defined as the diameter of a circle having a surface area equal to the projected surface area of the grain. The layers may also contain tabular silver halide crystals in which the ratio of diameter to thickness is substantially greater than 5:1, e.g. from 12:1 to 30:1.

The silver halide grains may also have a multi-layered grain structure which in the simplest case consists of an inner and an outer region (core/shell) which differ from one another in the halide composition and/or in other modifications, such as doping. The average grain size of the emulsions is preferably from 0.2 μm to 2.0 μm and the grain size distribution may be either homodisperse or heterodisperse. A homodisperse grain size distribution is one in which 95% of the grains differ by not more than ±30% from the average grain size. In addition to containing silver halide, the emulsions may also contain organic silver salts such as silverbenzotriazolate or silver behenate.

Two or more types of silver halide emulsions which have been prepared separately may be used as a mixture.

The photographic emulsions may be prepared from soluble silver salts and soluble halides by various methods (e.g. P. Glafkides, Chimie et Physique Photographique, Paul Montel, Paris (1967), G. F. Duffin, Photographic Emulsion Chemistry, The Focal Press, London (1966), V. L. Zelikman et al, Making and Coating Photographic Emulsion, The Focal Press, London (1966)).

Precipitation of the silver halide may be carried out in an acid, neutral or alkaline pH, preferably with the addition of silver halide complex formers such as, for example, ammonia, thio ethers, imidazole, ammonium thiocyanate or excess halide. The water soluble silver salts and the halides may selectively be brought together in succession by the single jet process of simultaneously by the double jet process of by any combination of the two processes. They are preferably dosed at increasing inflow rates but without exceeding the "critical" inflow rate at which new nuclei just fail to be produced. The pAg may vary within wide limits during precipitation and is preferably controlled by employing the so called pAg controlled process in which the pAg is either kept constant at a particular level or arranged to pass through a predetermined pAg profile during precipitation. Instead of the preferred method of precipitating with an excess of halide, the so called inverse method of precipitation using an excess of silver ions may be employed. Growth of the silver halide crystals may be brought about not only be precipitation but also by physical ripening (Ostwald ripening) in the presence of excess halides and/or silver halide complex formers. Growth of the emulsion grains may in fact take place predominantly by Ostwald ripening, in which case a fine grained, so called Lippmann emulsion is advantageously mixed with a more sparingly soluble emulsion and is redissolved and reprecipitated on the latter.

Salts or complexes of metals such as Cd, Zn, Pb, Tl, Bi, Ir, Rh or Fe may be present during the precipitation and/or physical ripening of the silver halide grains.

The precipitation may also be carried out in the presence of sensitizing dyes. Complex forming agents and/or dyes may be rendered inactive at any stage, e.g. by altering the pH or by an oxidative treatment.

When crystal formation has been completed or at an earlier stage, the soluble salts are removed from the emulsion by flocculation and washing.

The silver halide emulsion is generally subjected to a chemical sensitization under specified conditions of pH, pAg, temperature and concentration of gelatine, silver halide and sensitizer until the sensitivity and fogging optimum is reached. The procedure is described, for example, by H. Frieser in "Die Grundlagen der Photographischen Prozesse mit Silberhalogeniden", pages 675 to 734, Akademische Verlagsgesellschaft (1968).

Chemical sensitization may be carried out with the addition of compounds of sulphur, selenium or tellurium and/or noble metal compounds (e.g. compounds of gold, platinum, palladium or iridium). Thiocyanate compounds, surface active compounds such as thio ethers, heterocyclic nitrogen compounds (e.g. imidazoles, azaindenes) or spectral sensitizers may also be added (described e.g. in "The Cyanine Dyes and Related Compounds", by F. Hamer, 1964, or in Ullmanns Encyclopadie der technischen Chemie, 4th Edition, volume 18, pages 431 et seq and Research Disclosure number 17643, section III). A reduction sensitization with the addition of reducing agents (tin-II salts, amines, hydrazine derivatives, amino boranes, silanes or formamidine sulphinic acid) or hydrogen or by using a low pAg (e.g. below 5) and a high pH (e.g. above 8) may be carried out instead of or in addition to the chemical sensitization.

The photographic emulsions may contain compounds for preventing fogging or for stabilizing the photographic function during production, storage or photographic processing.

Azaindenes are particularly suitable, especially tetra and penta azaindenes and particularly those which are substituted with hydroxyl or amino groups. Compounds of this type are described e.g. by Birr in Z. Wiss. Phot. 47 (1952), pages 2 to 58. Salts of metals such as mercury or cadmium, aromatic sulphonic or sulphinic acids such as benzene sulphinic acid and nitrogen-containing heterocyclic compounds such as nitrobenzimidazole, nitroindazole, substituted or unsubstituted benzotriazoles or benzothiazolium salts may be used as antifoggants. Heterocyclic compounds containing mercapto groups are particularly suitable, e.g. mercaptobenzothiazoles, mercaptobenzimidazoles, mercaptotetrazoles, mercaptothiadiazoles and mercaptopyrimidines. These mercaptoazoles may also contain a water solubilizing group, e.g. a carboxyl group or sulpho group. Other suitable compounds are published in Research Disclosure number 17643 (1978), section VI.

The stabilizers may be added to the silver halide emulsions before, during or after ripening. The compounds may, of course, also be added to other photographic layers associated with a silver halide layer.

Mixtures of two or more of the above mentioned compounds may be used.

The photographic emulsion layers or other hydrophilic colloid layers of the light sensitive material prepared according to the invention may contain surface active agents for various purposes such as coating aids or surface active agents for preventing electric charging, for improving the slip properties, for emulsifying the dispersion, for preventing adhesion and for improving the photographic characteristics (e.g. development acceleration, high contrast, sensitization, etc.). Apart from natural surface active compounds such as saponin, the surface active compounds used are mainly synthetic compounds (tensides), including non-ionic surface active agents such as alkylene oxide compounds, glycerol compounds or glycidol compounds, cationic surface active agents such as higher alkylamines, quaternary ammonium salts, pyridine compounds and other heterocyclic compounds, sulphonium compounds or phosphonium compounds, anionic surface active agents containing an acid group such as a carboxylic acid, sulphonic acid, phosphoric acid, sulphuric acid ester or a phosphoric acid ester group and ampholytic surface active agents such as amino acid compounds and amino sulphonic acid compounds and sulphuric or phosphoric acid esters of an amino alcohol.

The photographic emulsions may be spectrally sensitized with methine dyes or other dyes. Cyanine dyes, merocyanine dyes and complex merocyanine dyes are particularly suitable.

A survey or polymethine dyes suitable for use as spectral sensitizers, suitable combinations of these dyes and combinations which have a super sensitizing action is given in Research Disclosure 17643/1978, section VI.

The following dyes, grouped according to their spectral regions, are particularly suitable:

1. Red sensitizers:

9-ethylcarbocyanine containing benzothiazole, benzoselenazole or naphthothiazole as basic end groups which may be substituted by halogen, methyl, methoxy, carbalkoxy or aryl in the 5- and/or 6-position; and 9-ethyl-naphthoxathia- or -selenocarbocyanine and 9-ethyl-naphthothiaoxa--or -benzimidazocarbocyanines, provided that the dyes carry at least one sulpho alkyl group on the heterocyclic nitrogen atom.

2. Green sensitizers:

9-ethylcarbocyanines containing benzoxazole, naphthoxazole or a benzoxazole and a benzothiazole as basic end groups; and benzimidazocarbocyanines which may also be further substituted and must also contain at least one sulpho alkyl group on the heterocyclic nitrogen atom.

3. Blue sensitizers:

symmetric or asymmetric benzimidazo-, oxa-, thia- or selena-cyanines containing at least one sulpho alkyl group on the heterocyclic nitrogen atom and optionally other substituents on the aromatic nucleus; and apomerocyanines containing a thiocyanate group.

The emulsions may contain other binders in addition to the gelatines according to the invention, such as synthetic polymers or natural high molecular weight layer-forming substances.

The emulsions according to the invention are suitable for all types of photographic materials, such as X-ray films, black and white films and black and white paper but especially for colour photographic materials.

Examples of colour photographic materials include colour negative films, colour reversal films, colour positive films, colour photographic paper, colour reversal photographic paper and colour sensitive materials for the dye diffusion transfer process or the silver dye bleaching process.

The supports used for the preparation of the colour photographic materials may be, for example, films or foils of semisynthetic or synthetic polymers such as cellulose nitrate, cellulose acetate, cellulose butyrate, polystyrene, polyvinyl chloride, polyethylene terephthalate or polycarbonate or paper laminated with a baryta layer or a layer of α-olefine (e.g. polyethylene). These supports may be coloured with dyes and pigments, e.g. titanium dioxide. They may also be coloured black for shielding off the light. The surface of the support is generally subjected to a treatment to improve adhesion of the photographic emulsion layer, for example a corona discharge followed by the application of a substrate layer.

The colour photographic materials normally contain at least one red sensitive, one green sensitive and one blue sensitive silver halide emulsion layer and optionally interlayers and protective layers.

In addition to the binders and silver halide grains, the colour couplers are essential components of the photographic emulsion layers.

The differently sensitized emulsion layers are associated with non-diffusible monomeric or polymeric colour couplers which may be situated in the layer with which they are associated or in an adjacent layer. Cyan couplers are generally associated with the red sensitive layers, magenta couplers with the green sensitive layers and yellow couplers with the blue sensitive layers.

Colour couplers for producing the cyan partial colour image are generally couplers of the phenol or α-naphthol series.

Colour couplers for producing the magenta partial colour image are generally couplers of the 5-pyrazolones series, the indazolone series or the pyrazoloazole series.

Colour couplers for producing the yellow partial colour image are generally couplers containing an open chained ketomethylene group, in particular couplers of the α-acyl acetamide type. α-Benzoyl acetanilide couplers and α-pivaloyl acetanilide couplers are suitable examples of these.

The colour couplers may be 4-equivalent couplers of 2-equivalent couplers. The latter are derived from 4-equivalent couplers in that they contain, in the coupling position, a substituent which is split off in the coupling reaction. 2-equivalent couplers include colourless couplers as well as couplers which have an intense colour of their own which disappears in the process of colour coupling to be replaced by the colour of the image dye produced (masking couplers) and white couplers which give rise to substantially colourless products in their reaction with colour developer oxidation products. The 2-equivalent couplers also include couplers which contain, in the coupling position, a removable group which is released in the reaction with colour developer oxidation products to give rise to a particular photographic effect, e.g. as development inhibitor or accelerator, either directly or after it has itself released one or more additional groups (e.g. DE-A-27 03 145, DE-A-28 55 697, DE-A-31 05 026 and DE-A-33 19 428). The known DIR couplers as well as DAR couplers and FAR couplers are examples of such 2-equivalent couplers.

DIR couplers which release development inhibitors of the azole type, e.g. triazoles and benzotriazoles, are described in DE-A-24 14 006, 26 10 546, 26 59 417, 27 54 281, 27 26 180, 36 25 219, 36 30 564, 36 36 824, 36 44 416 and 28 42 063. Other advantages for colour reproduction, i.e. colour separation and colour purity and for detailed reproduction, i.e. sharpness and graininess, may be obtained with DIR couplers which, for example, do not split off the development inhibitor immediately as a result of coupling with an oxidized colour developer but only after a subsequent reaction which may be obtained, for example, with a time control group. Examples of such couplers are described in DE-A-28 55 697, 32 99 671, 38 18 231 and 35 18 797, EP-A-157 146 and 204 175, US-A-4 146 396 and 4 438 393 and GB-A-2 072 363.

DIR couplers capable of releasing a development inhibitor which is decomposed in the developer bath to form photographically substantially inert products are described, for example, in DE-A-32 09 486 and in EP-A-167 168 and 219 713. Trouble free development and constantcy of processing are thereby achieved.

If suitable measures are carried out in the process of optical sensitization, the use of DIR couplers, especially those which split off a readily diffusible development inhibitor, enables improvements in colour reproduction to be achieved, e.g. a more highly differentiated colour reproduction, as described, for example, in EP-A-115 304 and 167 173, GB-A-2 165 058, DE-A-37 00 419 and US-A-4 707 436.

The DIR couplers may be added to many different layers in a multilayered photographic material, including, for example, light insensitive layers or interlayers, but they are preferably added to the light sensitive silver halide emulsion layers, in which the characteristic properties of the silver halide emulsion, e.g. its iodide content, the structure of the silver halide grain or the grain size distribution influence the photographic properties obtained. The influence of the released inhibitors may be limited, for example, by the incorporation of an inhibitor acceptor layer according to DE-A-24 31 223. For reasons of reactivity or stability, it may be advantageous to use a DIR coupler which, when it undergoes the coupling reaction, gives rise to a colour which is different from the colour to be produced in the layer in which the DIR coupler has been introduced.

For increasing the sensitivity, the contrast and the maximum density, it is particularly advantageous to use DAR or FAR couplers which split off a development accelerator or a foggant. Compounds of this type are described, for example, in DE-A-25 34 466, 32 09 110, 33 33 355, 34 10 616, 34 29 545 and 34 41 823, EP-A-89 834, 110 511, 118 087 and 147 765 and US-A-4 618 572 and 4 656 123.

An example of the use of BAR couplers (bleach accelerator releasing coupler) may be found in EP-A-193 389.

It may be advantageous to modify the action of a photographically active group split off from a coupler by causing this photographically active group to enter into an intermolecular reaction with another group after it has been released, as described in DE-A-35 06 805.

Since it is mainly the activity of the group released in the coupling reaction which is required from DIR, DAR and FAR couplers and the colour producing properties of these couplers is therefore less important, it is also suitable to use DIR, DAR and FAR couplers which give rise to substantially colourless products in the coupling reaction (DE-A-15 47 640).

The releasable group may be a ballast group so that the reaction with colour developer oxidation products gives rise to coupling products which are diffusible or at least have a slight and limited mobility (US-A-4 420 556).

The material may also contain compounds which are not couplers but are capable of releasing, for example, a development inhibitor, a development accelerator, a bleaching accelerator, a developer, a silver halide solvent, a foggant or an antifoggant. Examples of such compounds include the so called DIR hydroquinones and other compounds as described, for example, in US-A-4 636 546, 4 345 024 and 4 684 604, in DE-A-31 45 640, 25 15 213 and 24 47 079 and in EP-A-198 438. These compounds fulfil the same function as DIR, DAR or FAR couplers except that they do not give rise to coupling products.

High molecular weight couplers are described, for example, in DE-C-1 297 417, DE-A-24 07 569, DE-A-31 48 125, DE-A-32 17 200, DE-A-33 20 079, DE-A-33 24 932, DE-A-33 31 743 and DE-A-33 40 376, EP-A-27 284 and US-A-4 080 211. High molecular weight colour couplers are generally prepared by the polymerisation of ethylenically unsaturated monomeric colour couplers but they may also be obtained by polyaddition or polycondensation.

The incorporation of couplers or other compounds in silver halide emulsion layers may be carried out by first preparing a solution, dispersion or emulsion of the particular compound and then adding this to the casting solution for the layer in which it is required. The choice of suitable solvents or dispersing agents depends on the solubility of the compound.

Methods for introducing substantially water insoluble compounds by a grinding process are described, for example, in DE-A-26 09 741 and DE-A-26 09 742.

Hydrophobic compounds may also be introduced into the casting solution by means of high boiling solvents, so called oil formers. Suitable methods are described, for example, in US-A-2 322 027, US-A-2 801 170, US-A-2 801 171 and EP-A-0 043 037.

So called polymeric oil formers, which may be oligomeric or polymeric, may be used instead of the high boiling solvents.

The compounds may also be introduced into the casting solution in the form of charged latices; see, for example, DE-A-25 41 230, DE-A-25 41 274, DE-A-28 35 856, EP-A-0 014 921, EP-A-0 069 671, EP-A-0 130 115 and US-A-4 291 113.

Anionic, water soluble compounds (e.g. dyes) may also be incorporated in a diffusion fast form with the aid of cationic polymers, so called mordanting polymers.

Examples of suitable oil formers include alkyl phthalates, phosphonic acid esters, phosphoric acid esters, citric acid esters, benzoic acid esters, amides, fatty acid esters, trimesic acid esters, alcohols, phenols, aniline derivatives and hydrocarbons.

The following are examples of suitable oil formers: dibutyl phthalate, dicyclohexyl phthalate, di-2-ethylhexyl phthalate, decyl phthalate, triphenyl phosphate, tricresyl phosphate, 2-ethyl-hexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphate, 2-ethylhexylbenzoate, dodecyl benzoate, 2-ethylhexyl-p-hydroxy benzoate, diethyldodecanamide, N-tetradecylpyrrolidone, isostearyl alcohol, 2,4-di-tert.-amylphenol, dioctyl acetate, glycerol tributyrate, isostearyl lactate, trioctyl citrate, N,N-dibutyl-2-butoxy-5-tert.-octyl aniline, paraffin, dodecyl benzene and diisopropyl naphthalene.

Each of the differently sensitized light sensitive layers may consist of a single layer or of two or more silver halide emulsion partial layers (DE-C-1 121 470). Red sensitive silver halide emulsions are frequently arranged closer to the layer support than green sensitive emulsion layers, which in turn are arranged closer to the support than blue sensitive layers and a light insensitive yellow filter layer is generally situated between the green sensitive layers and the blue sensitive layers.

If the intrinsic sensitivity of the green sensitive or red sensitive layers is sufficiently low, the yellow filter layer may be omitted and different layer arrangements may be chosen, in which, for example, the blue sensitive layers are placed closest to the support, followed by the red sensitive layers and finally the green sensitive layers.

The light insensitive interlayers generally arranged between layers differing in their spectral sensitivity may contain substances to prevent accidental diffusion of developer oxidation products from one light sensitive layer to another light sensitive layer of a different spectral sensitization.

Suitable substances, also known as scavengers or EOP acceptors, are described in Research Disclosure 17643 (December 1978), chapter VII, 17842/1979, pages 94–97 and 18716/1979, page 650 and in EP-A-69 070, 98 072, 124 877 and 125 522 and in US-A-463 226.

If a material contains several partial layers of the same spectral sensitization, these may differ from one another in their composition, especially in the nature and quantity of the silver halide grains. The partial layer of the higher sensitivity is generally arranged further away from the support than the partial layer of lower sensitivity. Partial layers of the same spectral sensitization may be arranged adjacent to one another or separated by other layers, e.g. by layers of a different spectral sensitization. Thus, for example, all highly sensitive layers may be combined to form a layer packet and all low sensitivity layers may be combined to form another layer packet (DE-A-1 958 709, DE-A-25 30 645 and DE-A-26 22 922).

The photographic material may also contain UV light absorbent compounds, white toners, spacers, filter dyes, formalin acceptors, light protective agents, antioxidants, $D_{min}$ dyes, additives for improving the stabilization of the dyes, couplers and whites and additives for reducing the colour fog as well as plasticizers (latices), biocidal compounds, etc.

UV light absorbent compounds are required on the one hand to protect the image dyes against bleaching by daylight with a high UV content and on the other hand as filter dyes to absorb the UV light present in the daylight used for exposure and thus improve the colour reproduction of a film. Compounds of a different structure are generally used for the two purposes. Examples include aryl-substituted benzotriazole compounds (US-A-3 533 794), 4-thiazolindone compounds (US-A-3 314 794 and 3 352 681), benzophenone compounds (JP-A-2784/71), cinnamic acid ester compounds (US-A-3 705 805 and 3 707 375), butadiene compounds (US-A-4 045 229) and benzoxazole compounds (US-A-3 700 455).

Ultraviolet-absorbent couplers (such as cyan couplers of the α-napthol series) and ultraviolet absorbent polymers may also be used. These ultraviolet absorbents may be fixed in a particular layer by mordanting.

Filter dyes suitable for visible light include oxonol dyes, hemioxonole dyes, styryl dyes, merocyanine dyes, cyanin dyes and azo dyes. Among these dyes, oxono dyes, hemioxonole dyes and merocyanine dyes are particularly advantageous.

Suitable white toners are described e.g. in Research Disclosure 17643 (December 1978) chapter V, in US-A-2 632 701 and 3 269 840 and in GB-A-852 075 and 1 319 763.

Certain layers of binders, especially those which are furthest removed from the support but occasionally also interlayers, especially if they were furthest removed from the support during the preparation of the material, may contain photographically inert particles of an inorganic or organic nature, e.g. as matting agents or as spacers (DE-A-33 31 542, DE-A-34 24 893, and Research Disclosure 17643, December 1978, chapter XVI).

The average particle diameter of the spacers is mainly in the range of from 0.2 to 10 μm. The spacers are insoluble in water and may be soluble or insoluble in alkalis. Those which are alkali soluble are generally removed from the photographic material by the alkaline development bath. The following are examples of suitable polymers: polymethyl methacrylate, copolymers of acrylic acid and methyl methacrylate, and hydroxypropyl methyl cellulose hexahydrophthalate.

Additives for improving the stability of the dyes, couplers and whites and for reducing the colour fog (Research Disclosure 17643/1978, chapter VII) may belong to the following classes of chemical compounds: hydroquinones, 6-hydroxy chromans, 5-hydroxy coumarans, spirochromanes, spiroindanes, p-alkoxyphenols, sterically hindered phenols, gallic acid derivatives, methylene dihydroxy benzenes, amino phenols, sterically hindered amines, derivatives containing esterified or etherified phenolic hydroxyl groups and metal complexes.

Compounds containing both a sterically hindered amine partial structure and a sterically hindered phenol partial structure in one and the same molecule (US-A-4 268 593) are particularly effective in preventing any impairment (deterioration or degradation) to yellow colour images as a result of heat, moisture or light. Spiroindanes (JP-A-1 596 44/81) and chromans substituted by hydroquinone diethers or monoethers (JP-A-89 835/80) are particularly effective in preventing impairment (deterioration or degradation) to magenta colour images, especially impairment (deterioration or degradation) due to the action of light.

The layers of the photographic material may be hardened with conventional hardeners. Examples of suitable hardeners include formaldehyde, glutaraldehyde and similar aldehyde compounds, diacetyl, cyclopentadione and similar ketone compounds, bis-(2-chloroethyl urea), 2-hydroxy-2,6-dichloro-1,3,5-triazine and other compounds containing reactive halogen (US-A-3 288 775, US-A-2 732 303, GB-A-974 723 and GB-A-1 167 207), divinyl sulphone compounds, 5-acetyl-1,3-diacryloyl-hexahydro-1,3,5-triazine and other compounds containing a reactive olefine bond (US-A-3 635 718, US-A-3 232 763 and GB-A-994 869), N-hydroxymethyl phthalimide and other N-methylol compounds (US-A-2 732 316 and US-A-2 586 168), isocyanates (US-A-3 103 437), aziridine compounds (US-A-3 017 280 and US-A-2 983 611), acid derivatives (US-A-2 725 294 and US-A-2 725 295), compounds of the carbodiimide type (US-A-3 100 704), carbamoylpyridinium salts (DE-A-22 25 230 and DE-A-24 39 551), carbamoyloxypyridinium compounds (DE-A-24 08 814), compounds containing a phosphorous-halogen bond (JP-A-113 929/83), N-carbonyloximide compounds (JP-A-43353/81), N-sulphonyloximido compounds (US-A-4 111 926), dihydroquinoline compounds (US-A-4 013 468), 2-sulphonyloxypyridinium salts (JP-A-110 762/81), formamidinium salts (EP-A-0 162 308), compounds containing two or more N-acyloximino groups (US-A-4 052 373), epoxy compounds (US-A-3 091 537), compounds of the isoxazole type (US-A-3 321 313 and US-A-3 543 292), halogenocarboxy aldehydes such as mucochloric acid; dioxane derivatives such as dihydroxydioxane and dichlorodioxane; and inorganic hardeners such as chrome alum and zirconium sulphate.

Hardening may be brought about in known manner by adding the hardener to the casting solution for the layer which is to be hardened or by coating the layer with a layer which contains a diffusible hardener.

The classes mentioned above include both slow acting hardeners and quick acting hardeners as well as so called instant hardeners, which are particularly advantageous. Instant hardeners are compounds which effect cross-linking of suitable binders at such a rate that hardening has been completed to such a degree either immediately after casting or at the latest after 24 hours, preferably after not more than 8 hours, that no further change in sensitometry or swelling of the combination of layers due to a cross-linking reaction can occur. The "swelling" is the difference between the wet layer thickness and the dry layer thickness of a film processed under aqueous conditions (Photographic Sci., Eng. 8 (1964), 275; Photographic Sci. Eng. (1972), 449).

Examples of these hardeners which react very rapidly with gelatine include carbamoylpyridinium salts, which are capable of reacting with free carboxyl groups of the gelatine so that the latter react with free amino groups of the gelatine to form a peptide bond and bring about cross-linking of the gelatine.

Some hardeners are diffusible and have the same hardening action on all the layers within a combination of layers. Other hardeners, which may be either low molecular or high molecular hardeners, are non-diffusible and limited in their action to the layer in which they are situated. These may be used for particularly powerful cross-linking of individual layers, e.g. the protective layer. This is important when the silver halide layer is hardened to only a slight extent for the purpose of increasing the silver covering power and the protective layer is then required for improving the mechanical properties (EP-A-0 114 699).

Colour photographic negative materials are normally processed by development, bleaching, fixing and washing or by development, bleaching, fixing and stabilization without washing. Bleaching and fixing may be carried out separately or as a combined step. The colour developer compounds used may be any developer compounds which are capable, in the form of their oxidation products, of reacting with colour couplers to form azomethine or indophenol dyes. Aromatic compounds of the p-phenylene diamine series containing at least one primary amino group are suitable for use as colour developer compounds, e.g. N,N-dialkyl-p-phenylene diamines such as N,N-diethyl-p-phenylene diamine, 1-(N-ethyl-N-methanesulphonamidoethyl)-3-methyl-p-phenylene diamine, 1-(N-ethyl-N-hydroxyethyl)-3-methyl-p-phenylene diamine and 1-(N-ethyl-N-methoxyethyl)-3-methyl-p-phenylene diamine. Other suitable colour developers are described, for example, in J. Amer. Chem. Soc. 73, 3106 (1951) and by G. Haist in Modern Photographic Processing, 1979, John Wiley and Sons, New York, pages 545 et seq.

Colour development may be followed by an acid short stop bath or by washing.

The material is normally bleached and fixed immediately after colour development. The bleaching agents used may be e.g. Fe(III) salts and Fe(III) complex salts such as ferricyanides, dichromates or water soluble cobalt complexes. Iron-(III) complexes of aminopolycarboxylic acids are particularly preferred, e.g. the complexes of ethylene diamino tetraacetic acid, propylene diamino tetraacetic acid, diethylenetriamine pentaacetic acid, nitrilotriacetic acid, iminodiacetic acid, N-hydroxyethyl ethylene diamino triacetic acid or of alkyliminodicarboxylic acids and corresponding phosphonic acids. Persulphates and peroxides are also suitable bleaching agents, e.g. hydrogen peroxide.

The bleach fixing bath or fixing bath is in most cases followed by washing which may be carried out as a countercurrent washing or in several tanks, each with its own water supply.

Advantageous results may be obtained by following this washing with a final bath containing little or no formaldehyde.

Washing may be completely replaced by a stabilizing bath, which is normally used in countercurrent. When formaldehyde is added, this stabilizing bath also fulfils the function of a final bath.

In colour reversal materials, development is first carried out with a black and white developer whose oxidation product is not capable of reacting with the colour couplers. This is followed by a diffuse second exposure which in turn is followed by development with a colour developer, bleaching and fixing.

The following alkaline ashed inert bone gelatines were used for the examples:

| | Cysteine content (ppm) | Gold Number (μmol/g) | Viscosity (mPas of the 10% by weight solution at 40° C.) |
|---|---|---|---|
| Gelatine 1 | 12 | 23 | 22 |
| Gelatine 2 | 8 | 23 | 22 |
| Gelatine 3 | 6 | 23 | 22 |
| Gelatine 4 (oxidized) | 6 | 5 | 20 |

EXAMPLE 1

A silverchloro bromide emulsion containing 5 mol % of bromide was prepared with gelatine 1 by the double jet process at 52° C. The GeSi was 0.15 at the end of the silver halide precipitation. The emulsion was flocculated by the addition of a flocculating agent and lowering of the pH to 3.5 and was then washed. The pH was readjusted to 4.5, a further quantity of gelatine was added and the emulsion was redispersed with heating. The GeSi was then 0.65. The emulsion was ripened to maximum sensitivity with gold salts and thiosulphate (Emulsion A).

Another emulsion was prepared with gelatine 2 (Emulsion B) by the same process.

Yet another emulsion was prepared with gelatine 3 (Emulsion C) by the same process.

Another emulsion was prepared with gelatine 4 (Emulsion D) by the same process.

The grain size distributions were determined with a Möller counter (G. Möller Intern. Congress Phot. Sci. Moscow 1970, p. 125).

180 mg of a blue sensitizer and 120 g of a yellow coupler per 100 g of $AgNO_3$ were added to the emulsions. Wetting agents were also added to the emulsions. The emulsions were then cast on a PE-coated paper support, and a gelatine layer containing a hardener was applied to the emulsion layer. After drying of the layer, the samples were exposed in a sensitometer and developed by the RA4 process.

Determination of the latent image was carried out 6 hours after exposure, the exposed strip having been stored at room temperature.

The materials which were developed immediately and those which were developed after 6 hours storage were compared to find the ΔE latent image (log./t).

| Emulsion | Grain Distribution V | | Sensitometry E | S | G1 | log. It. Latent Image |
|---|---|---|---|---|---|---|
| A | 0.46 | Formation of new nuclei | 100 | 0.107 | 1.82 | −0.10 |
| B | 0.38 | Very slight formation of new nuclei | 120 | 0.109 | 1.87 | −0.11 |
| C | 0.37 | Very slight formation of new nuclei | 130 | 0.112 | 1.89 | −0.10 |
| D | 0.45 | Very slight formation of new nuclei | 120 | 0.152 | 1.79 | −0.25 |

Figure 2:
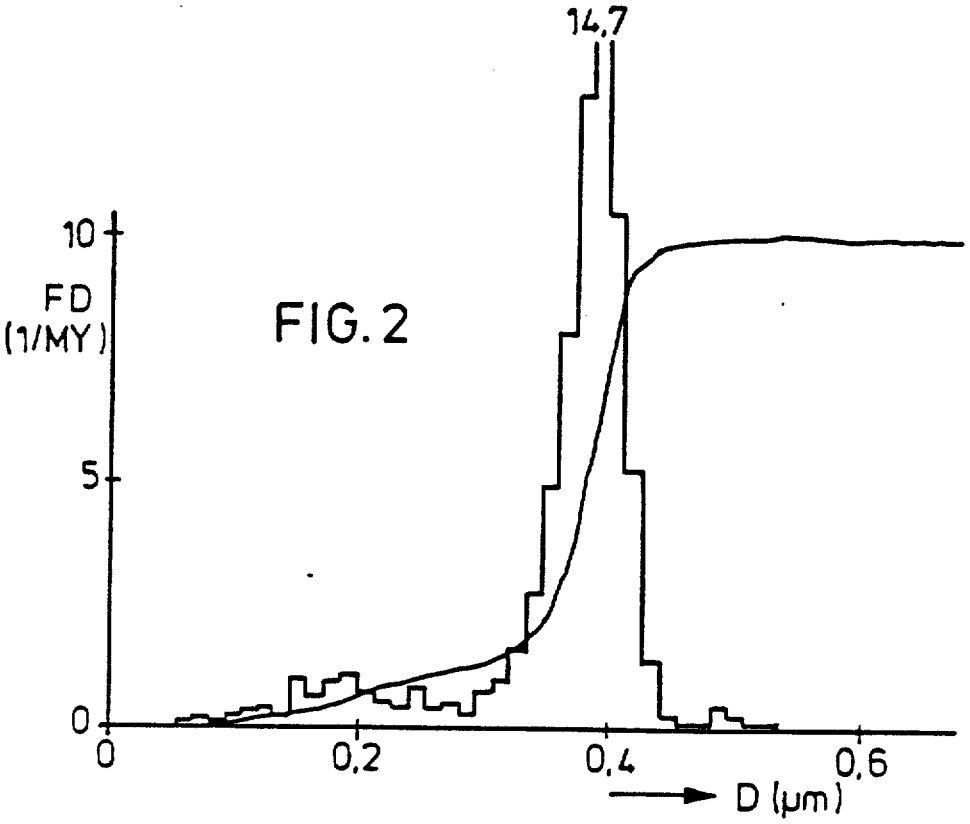
Figure 3:
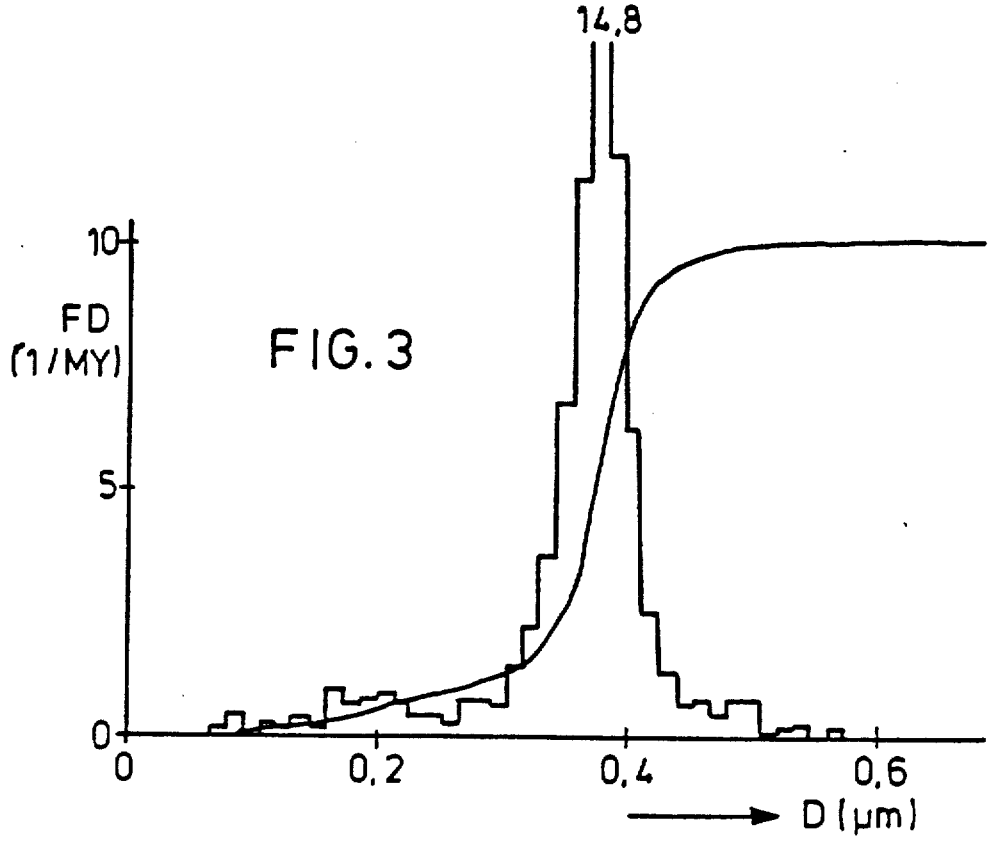
Figure 4:
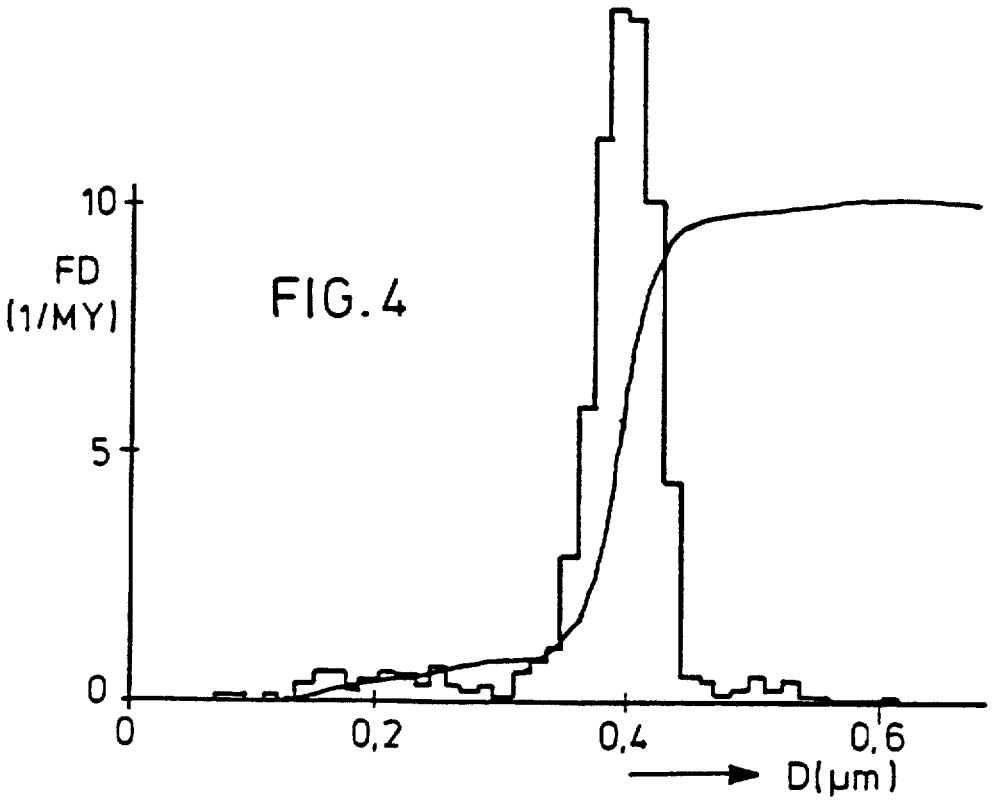

V: volume centre of gravity in μm of all the silver halide grains measured
E: relative sensitivity
S: fog
Gamma 1: rise in characteristic curve between the points 0.1 above fog and 0.85 above fog The grain distributions are shown in FIG. 1 (Emulsion A), FIG. 2 (B), FIG. (C) and FIG. 4 (D).

The example shows that as the cysteine content decreases, the sensitivity rises considerably but the fog only very slightly. There is little influence on the latent image. When an oxidized gelatine with a low cysteine content is used, an improvement in sensitivity is accompanied by a steep rise in the fog and deterioration of the latent image.

EXAMPLE 2

A silver iodobromide emulsion for a colour reversal material containing 4 mol % of iodide was prepared by the double jet method at 62° C., gelatine 1 being added to the iodine. After precipitation, the GeSi was 0.20. The emulsion was flocculated with the addition of a flocculating agent and lowering of the pH of 3.5 and was then washed. The emulsion was redispersed at pH 6.5 with the addition of a further quantity of gelatine 1 and heating. The GeSi was then 0.8. The emulsion was ripened with gold salts and thiosulphate and a sample was removed every 20 minutes (Emulsion E).

Another experiment was carried out by the same method as described above but with gelatine 3 (Emulsion F).

In yet another experiment, the same method was applied to gelatine 4 (Emulsion G).

The emulsions were spectrally sensitized with 160 mg/100 g of $AgNO_3$ of a green sensitizer and 69 g/100 g of $AgNO_3$ of a magenta coupler were added. The emulsions were cast on an acetyl cellulose support. A gelatine layer containing a hardener was cast on the light sensitive layer. After drying, the samples were exposed and developed by the E6 process.

The samples which had the same reciprocity error at −3.0 ±0.2 (sensitivity difference in DIN between 1/20 seconds and 13 seconds exposure) were compared.

| Emulsion/ Ripening Time | E | Gamma/ $D_{max}$ | FA | RPF | Storage Test 3 days at 60° C. ΔE(log.It) | ΔGamma | $\Delta D_{max}$ |
|---|---|---|---|---|---|---|---|
| E/200' | 100 | 1.2 | 1.3 | −3.0 | −0.2 | −0.15 | −0.15 |
| F/160' | 125 | 1.3 | 1.25 | −3.2 | −0.15 | −0.15 | −0.20 |
| G/120' | 120 | 1.1 | 1.05 | −2.9 | −0.3 | −0.84 | −0.60 |

E: Sensitivity
FA: Colour yield (maximum density: $AgNO_3$ application)
RPF: Reciprocity failure in DIN The sensitometric data show that the highest sensitivity combined with steep gradation and high colour yield is obtained with Emulsion F. Emulsion F is stable during storage at high temperature whereas Emulsion G is found to be substantially less stable during storage at 60° C.

We claim:

1. Photographic silver halide emulsion containing gelatine, in which the gelatine has a cysteine content of less than 10 ppm and a gold number of ≧23 μmol/g.

2. Photographic silver halide emulsion according to claim 1, characterised in that the cysteine content is ≦8 ppm.

3. Photographic silver halide emulsion according to claim 1, characterised in that the gelatine is an alkaline limed bone gelatine having an isoelectric point of from 4.9 to 5.2.

4. Photographic silver halide material prepared using a photographic silver halide emulsion containing gelatine according to claims 1, 2 or 3.

* * * * *